US008713884B2

(12) United States Patent
Musick et al.

(10) Patent No.: US 8,713,884 B2
(45) Date of Patent: May 6, 2014

(54) METHODS AND ARRANGEMENTS FOR METAL BUILDING ROOF INSULATION

(75) Inventors: David Eugene Musick, Heath, OH (US); Ernest Craig Abney, Sanford, FL (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 13/560,302

(22) Filed: Jul. 27, 2012

(65) Prior Publication Data

US 2013/0047543 A1 Feb. 28, 2013

Related U.S. Application Data

(60) Provisional application No. 61/512,082, filed on Jul. 27, 2011.

(51) Int. Cl.
*E04D 1/34* (2006.01)

(52) U.S. Cl.
USPC ..... 52/543; 52/94

(58) Field of Classification Search
USPC ..... 52/543, 94, 90.1, 748.1
See application file for complete search history.

(56) References Cited

U.S. PATENT DOCUMENTS

| | | | | |
|---|---|---|---|---|
| 4,058,949 | A | 11/1977 | Bellem | |
| 4,075,806 | A * | 2/1978 | Alderman | 52/90.1 |
| 4,642,961 | A * | 2/1987 | Cruise | 52/408 |
| RE33,566 | E * | 4/1991 | Heckelsberg | 52/520 |
| 5,653,081 | A | 8/1997 | Wenrick et al. | |
| 5,685,123 | A | 11/1997 | Alderman et al. | |
| 5,724,780 | A | 3/1998 | Bolich | |
| 5,884,449 | A | 3/1999 | Alderman et al. | |
| 5,911,385 | A | 6/1999 | Neifer et al. | |
| 6,056,231 | A | 5/2000 | Neifer et al. | |
| 6,233,894 | B1 | 5/2001 | Abney et al. | |
| 6,694,693 | B2 * | 2/2004 | Alderman | 52/478 |
| 6,832,460 | B2 | 12/2004 | Fligg | |

OTHER PUBLICATIONS

Butler Manufacturing Company, MR-24 Roof System product brochures dated Aug. 2, 2010, 6 pgs.
Butler Manufacturing Company, MR-24 Roof System Panel Clip & Endlap brochure, copyright 2004, 2 pgs.

* cited by examiner

*Primary Examiner* — Basil Katcheves
(74) *Attorney, Agent, or Firm* — Calfee, Halter & Griswold LLP

(57) ABSTRACT

A metal roofing system includes at least one roof clip including a base portion secured to the upper portion of the at least one purlin, and flanged legs extending from opposite sides of the base portion, and a thermal spacer washer assembled between the at least one roof clip and the at least one purlin.

13 Claims, 9 Drawing Sheets

METHODS AND ARRANGEMENTS FOR METAL BUILDING ROOF INSULATION

CROSS-REFERENCE TO RELATED APPLICATION

This application claims the benefit of U.S. Provisional Patent Application Ser. No. 61/512,082 filed on Jul. 27, 2011, titled "Methods and Arrangements for Metal Building Roof Insulation." U.S. Provisional Patent Application No. 61/512,082 is incorporated herein by reference in its entirety.

BACKGROUND

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material must be supported between the purlins beneath the hard roofing material. Various methods of supporting the insulation material have been used. Some systems use a support sheet (also referred to as a facing or vapor barrier) to support the insulation material. The support sheet is draped from the adjacent purlins and the insulation material is placed on top of the support sheet. A carriage has been used to aid in the dispensing of the support sheet. The carriage is positioned on top of the purlins and travels the length of the purlins during the roof construction. A roll of the support sheet material is mounted on the carriage and the support sheet is payed out from the roll and placed on top of the purlins. As the carriage travels the length of the purlins, the support sheet is draped across the purlins.

Insulation material which is laid along the length of the purlins on top of the support sheet is typically dispensed from a roll (although other types of insulation material may be utilized). The roll of insulation may be provided on a carriage, similar to the support sheet, to be payed out as the carriage travels along the purlins. A support sheet and insulation may be simultaneously payed out from a single carriage.

SUMMARY

The present application describes exemplary methods and arrangements for metal building roof insulation. In one exemplary embodiment, a metal roofing system includes at least one roof clip including a base portion secured to the upper portion of the at least one purlin, and flanged legs extending from opposite sides of the base portion, and a thermal spacer washer assembled between the at least one roof clip and the at least one purlin.

In another exemplary embodiment, a metal roofing system includes first and second laterally spaced purlins each having a vertically extending portion, a support sheet draped over upper portions of the first and second purlins, and a rigid member inserted between the first and second purlins and disposed on a bottom-most portion of the support sheet. The rigid member substantially spans between the vertically extending portions of the first and second purlins, such that the rigid member extends to a bottom-most portion of the support sheet to form an expanded insulation cavity for insulation material deposited on the support sheet.

In still another exemplary embodiment, a metal roofing system includes at least one longitudinally extending purlin having a laterally extending upper portion, a cavity expanding bracket, a thermal block, and at least one roof clip. The cavity expanding bracket includes a longitudinally extending lower portion secured to the upper portion of the at least one purlin, a vertically extending wall, and a longitudinally extending upper portion. The thermal block is at least partially received between the upper portion of the cavity expanding bracket and the upper portion of the at least one purlin to restrict vertical movement of the thermal block. The at least one roof clip includes a base portion secured to the upper portion of the cavity expanding bracket, and an upper portion for supporting at least one roof panel.

BRIEF DESCRIPTION OF THE DRAWINGS

In the accompanying drawing which is incorporated in and constitutes a part of the specification, embodiments of the invention are illustrated, which, together with a general description of the invention given above, and the detailed description given below, serve to example the principles of this invention.

DETAILED DESCRIPTION

This Detailed Description merely describes embodiments of the invention and is not intended to limit the scope of the invention in any way. Indeed, the invention is broader than and unlimited by the preferred embodiments, and the terms used have their full ordinary meaning The present application contemplates exemplary methods and arrangements for insulating and/or installing a metal building roof for increased thermal resistance or reduced heat transfer coefficient through the metal roof. According to an aspect of the present application, thermal resistance of a metal roofing system may be enhanced by expanding an insulation cavity of the metal roof, or areas in which various insulating materials and components are disposed. In one embodiment, the insulation cavity may be expanded by extending insulation materials into spaces within the metal roof normally left empty (e.g., around the purlins and roof clips), for example, to reduce heat transfer through these spaces. In another embodiment, the insulation cavity may be expanded by extending the distance between the purlins and the roof panels to provide increased depth of insulation material between the purlins and roof panels.

Figure 1:
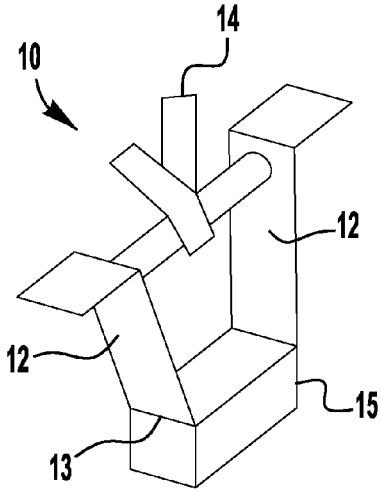
FIG. 1 is a perspective view of a conventional roof clip for securing a metal roof panel to a purlin.

According to an aspect of the present application, an insulation arrangement may be provided around clips or fasteners that support the roof panels on the underlying purlins. While many different clips or fasteners may be utilized, in one embodiment, a roof clip 10, shown in FIG. 1, includes flanged legs 12 that support the roof panels 5 (see FIG. 2C), and a sliding seam tab 14 that is captured in a seam formed between adjacent roof panels. The base 13 of the roof clip 10 may be attached directly to the purlin 20, or indirectly through a thermal insulating spacer washer 15 or spacer block (for example, to provide additional space for insulation material), for example, by a fastener 11. The sliding seam tab 14 allows for movement of the roof panels 5 (for example, due to expansion or contraction) without damaging the roof. One such roof clip is the BUTLER MR-24® roof clip sold by BlueScope Butler. The clips 10 may be provided along the length of each purlin 20 (for example, spaced 24 inches apart) for uniform support of the roof panels.

Figure 2A:
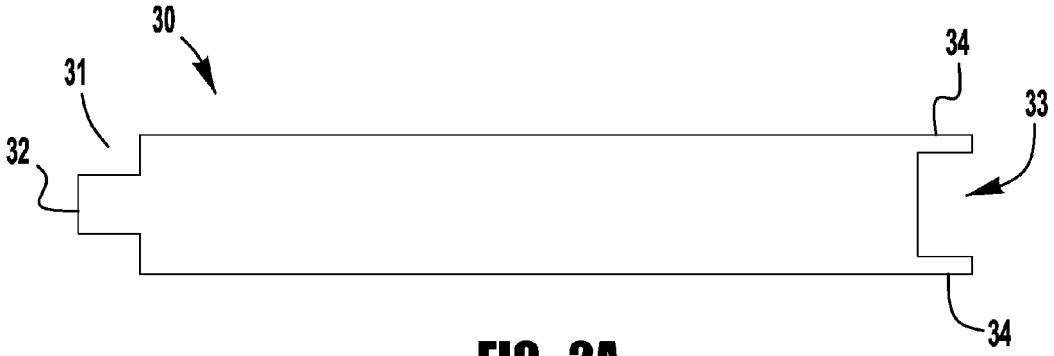
FIG. 2A is a top view of a thermal insulating spacer block for installation with a roof clip.
Figure 2B:
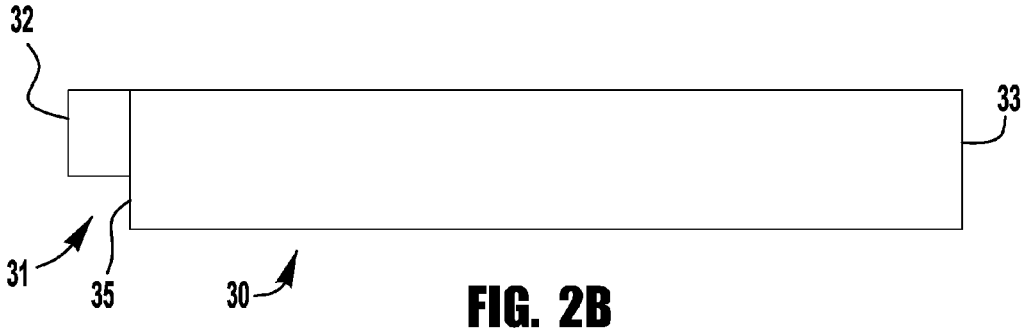
FIG. 2B is a side view of the thermal insulating spacer block of FIG. 2A.
Figure 2C:
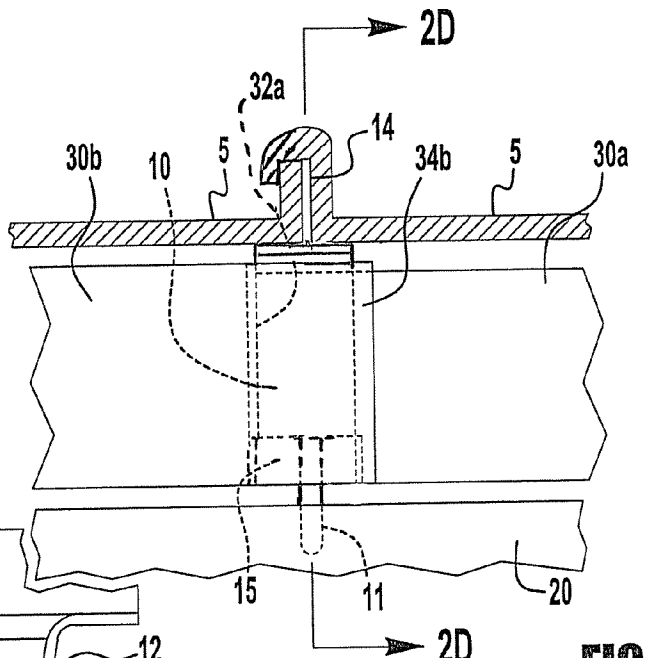
FIG. 2C is a partial side view of metal roofing assembly including the roof clip of FIG. 1 and thermal insulating spacer blocks of FIG. 2A assembled together between a purlin and roof panels.
Figure 2D:
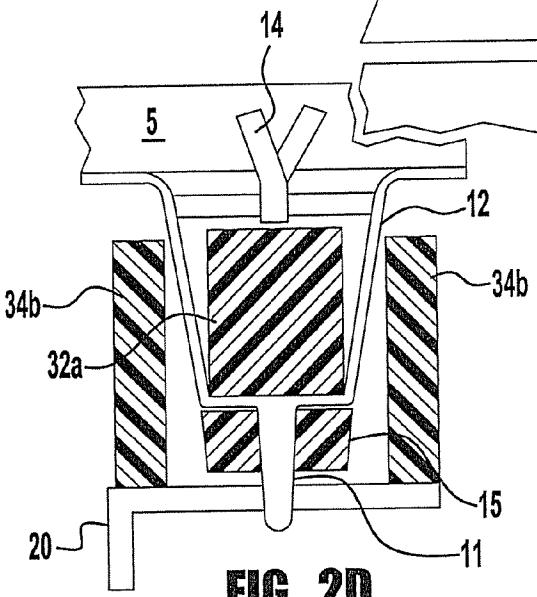
FIG. 2D is a cross sectional end view of the metal roofing assembly of FIG. 2C, taken along the lines 2D-2D.

To better insulate this connection between the roof panels 5 and the purlins 20, one or more insulating components may be configured to conform with the clips or fasteners to fill the empty space between the roof panels and the purlins, effectively increasing or expanding the insulation cavity of the metal roofing system. In one embodiment, thermal spacer blocks (for example, polystyrene or polyisocyanurate foam blocks) may be inserted between the roof clips along the purlins. FIGS. 2A and 2B illustrate top and side views of an exemplary thermal spacer block 30 having a first end 31 with a central tongue extension 32 sized to fit between the flanged legs 12 of a roof clip 10, and a second end 33 with side wall extensions 34 sized to fit around the flanged legs 12 of a second or adjacent roof clip 10. As such, the thermal spacer block 30 may be sized to extend between spaced apart roof clips 10 (for example, 24 inch long thermal spacer blocks where roof clips are spaced apart 24 inches). The tongue 32 may include a notch or recess 35 to accommodate a spacer washer 15 or other such intermediary connection between the roof clip 10 and the purlin 20. As shown in FIGS. 2C and 2D, when first and second thermal spacer blocks 30*a*, 30*b* are installed on opposite sides of a roof clip 10, the tongue 32*a* of the first thermal spacer block is received between the flanged legs 12 of the roof clip 10, and the side wall extensions 34*b* of the second spacer block 30*b* are slipped around the flanged legs 12 of the roof clip 10, thereby providing insulation around the metal roof clip 10. The thermal spacer blocks may be sized to provide clearance for the roof panels 5 and/or for one or more hardware components of a roof clip (for example, the sliding seam tab 14 and supporting bar 16), to allow for proper functioning of the roof clip 10. In an exemplary embodiment, a thermal spacer block 30 is approximately 4 inches tall and approximately 4 inches wide, with a 1 ½ inch wide and 1 ½ inch long tongue extension 32 above a 1 inch high lower notch or recess, and ½ inch wide, 1 ⅝" long side wall extensions 34.

Insulation material retained by a vapor barrier or support sheet may be adapted to more closely conform with the contours of the purlins, for example, for increased thermal resistance. In one example, a roll of support sheet payed out over the purlins may include pleats or folds. As the pleated support sheet is payed out into the insulation cavity, the pleats unfold to expand the width of the support sheet, allowing the insulation cavity to be more uniformly filled with insulation material, as compared to the bowed or sagged condition of an unpleated support sheet. Examples of such pleated support sheet arrangements are described in U.S. Pat. No. 5,653,081, the entire disclosure of which is incorporated herein by reference.

Figure 3:
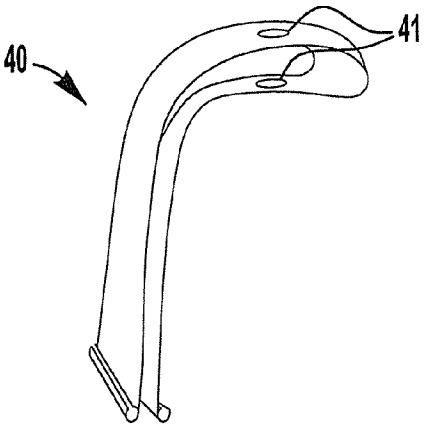
FIG. 3 is a schematic view of a support sheet clip.
Figure 4:
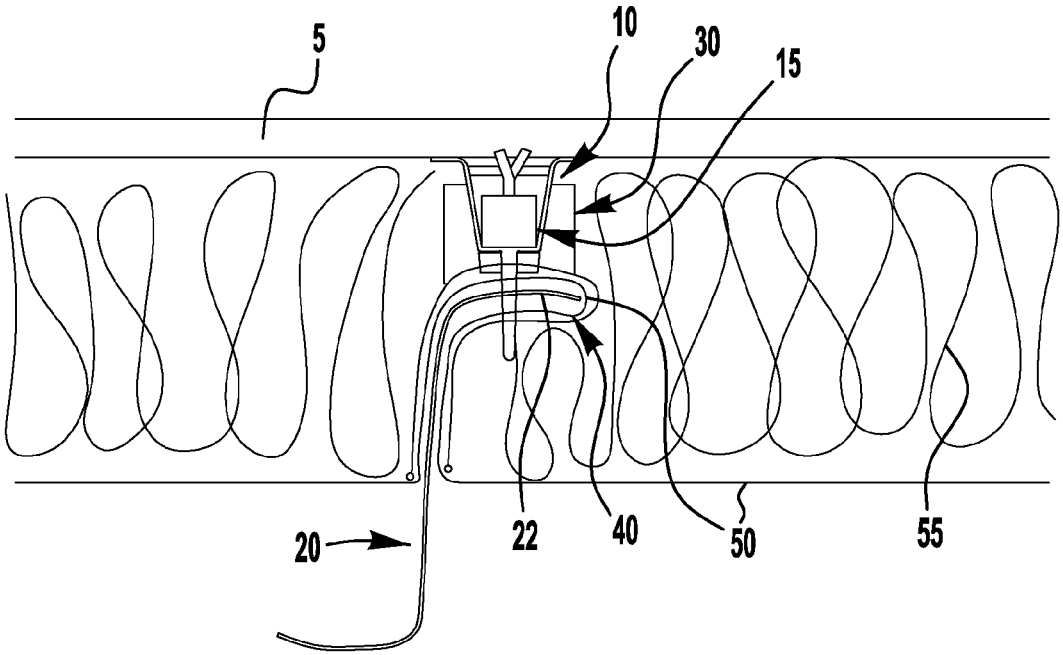
FIG. 4 is a schematic cross-sectional view of a metal roofing arrangement utilizing a thermal insulating spacer block and a support sheet clip.

Many purlin shapes (for example, a z-shaped cross-section or a c-shaped cross-section) impede conformity of the support sheet (and its contained insulation material) with at least one side of the purlin, for example, due to laterally extending portions of the purlin providing lateral spacing between a vertically extending portion of the support sheet and a vertically extending portion of the purlin. According to another aspect of the present application, a clip may be fastened over or around an upper portion of the purlin and a portion of the support sheet or sheets overlaying the purlin to conform these portions of the support sheets with the purlin, effectively expanding the insulation cavity of the metal roofing system. While many different types of clips may be utilized, in one embodiment, as shown in FIG. 3, a support sheet clip 40 may include a bendable and/or resilient band (for example, a 24 gage steel band) capable of wrapping around the upper portion of the purlin 20 to hold the overlying portions of the support sheet 50 in close conformity with the purlin 20. As shown in FIG. 4, this conformity of the support sheet 50 with the purlin 20 allows a space below an upper, laterally extending portion 22 of the purlin 20 to be filled with suitable insulation material 55 (for example, R30 insulation) contained by the support sheet 50, providing for enhanced insulation around the purlin 20. The support sheet clip 40 may be provided with one or more mounting holes 41 for securing the roof clip 10 (or other roof panel attachment structure) to the purlin 20.

To install an exemplary insulated metal roofing system utilizing some of the above described features, as shown in FIG. 4, one or more support sheets 50 are payed out across the purlins 20. One or more support sheet clips 40 are bent around, slid over, or snapped onto the upper end 22 of the purlin 20, over the support sheet 50, to closely conform the support sheet 50 to the shape of the upper portion 22 of the purlin 20. Roof clips 10 (with spacer washers 15) are fastened to the purlin 20 through mounting holes 41 in the support sheet clips 40. Thermal insulating spacer blocks 30 are installed onto the roof clips 10 with tongue and side wall extensions 32, 34 meshing with the roof clip legs 12. Thermal insulation 55 is payed out or otherwise deposited onto the support sheet 50 to fill the insulation cavity (for example, up to the upper ends of the roof clips 10). The roof panel 5 is then installed onto the roof clips 10.

While many different methods and apparatus may be utilized to pay out support sheets and insulation materials from above the purlins of a metal building roof, in one embodiment, an apparatus includes a carriage that is moved along the length of the purlins to pay out the support sheet and insulation material. Exemplary methods and apparatus utilizing such carriage-type arrangements are described, for example, in the following U.S. patents, the entire disclosures of which are incorporated herein by reference: U.S. Pat. Nos. 6,056,231; 6,233,894; 5,911,385; 5,884,449; 5,685,123; and 5,653,081. One or more of the systems and apparatus described in the incorporated references may be used in combination with the arrangements described herein.

Figure 5:
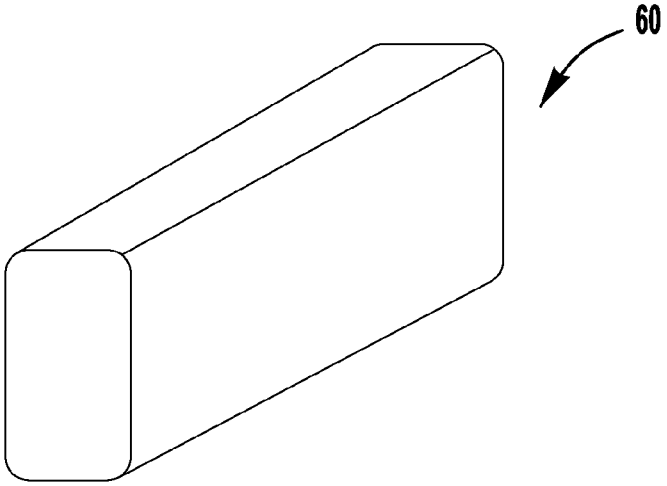
FIG. 5 is a perspective view of a thermal insulating spacer block for installation with a purlin.
Figure 6:
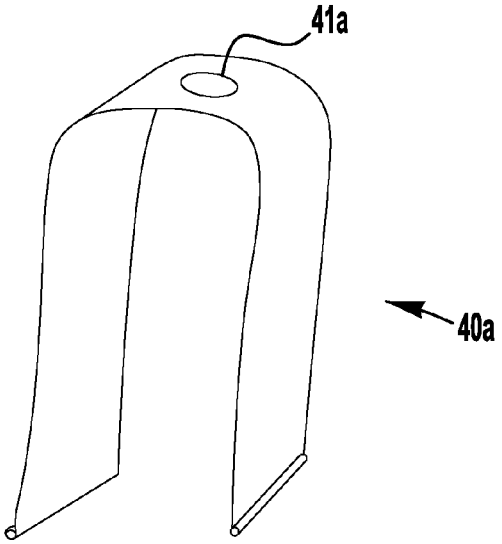
FIG. 6 is a schematic view of a support sheet clip for use with a purlin and thermal insulating spacer block.
Figure 7:
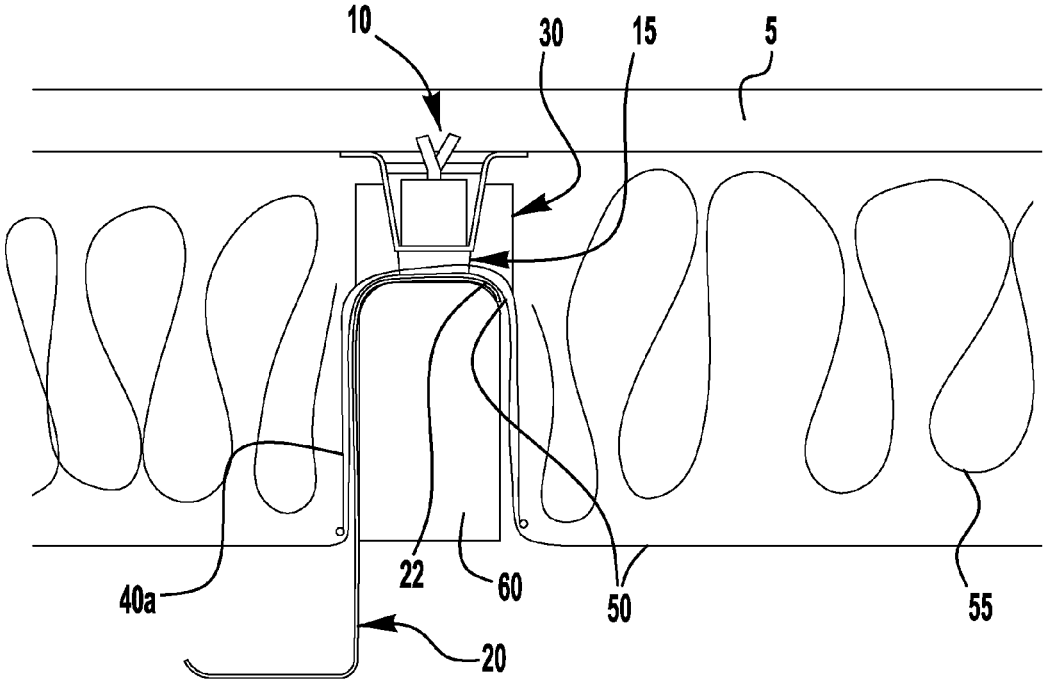
FIG. 7 is a schematic cross-sectional view of a metal roofing arrangement utilizing thermal insulating spacer blocks and a support sheet clip.

In another embodiment, one or more spaces around a purlin may be insulated using a separate insulation component, such as, for example, a thermal insulation block, panel, or other such insert. In one embodiment, as shown in FIGS. 5 and 7, a thermal insulation block 60 is sized to be closely received under an upper laterally extending portion 22 of the purlin 20, thereby substantially filling and insulating the empty space between the vertical portion 23 of the purlin 22 and the outer edge of the upper portion 22 of the purlin 20. The thermal insulation block 60 may be secured to the purlin 20 by one or more elongated fasteners extending through the roof clip 10 and purlin 20. As shown in FIG. 6, a support sheet clip 40*a*. which may, but need not, be similar to the support sheet clip 40 of FIG. 3, may be bent or otherwise shaped to be installed over the purlin 20, the thermal insulation block 60, and the overlying support sheets 50 to conform the support sheets 50 around the purlin 20 and thermal insulation block 60. In another embodiment, pleated or folded support sheets, as described above and in incorporated U.S. Pat. No. 5,653,081, may be configured to sufficiently conform to the vertical sides of the purlin 20 and thermal insulation block 60, without use of a support sheet clip. A thermal insulation block may extend an entire length of a purlin (for example, approximately 72 inches), or multiple, shorter insulation blocks may be used. The thermal insulation block 60 may, but need not, be provided with a height sufficient to extend from the upper portion 22 of the purlin 20 to the bottom-most portion of the installed support sheet 50 (for example, a height of approximately 6 inches).

To install an exemplary insulated metal roofing system utilizing some of the above described features, as shown in FIG. 7, one or more support sheets 50 are payed out across the purlins 20. One or more thermal insulation blocks 60 are positioned under the upper flanged portion of the purlin. One or more support sheet clips 40*a* are bent around, slid over, or snapped onto the upper end 22 of the purlin 20 and the thermal insulation block 60, and over the support sheet 50, to closely conform the support sheet 50 to the shape of the upper portion 22 of the purlin 20 and the thermal insulation block 60. Roof clips 10 (with spacer washers 15) are fastened to the purlin 20 and the thermal insulation block 60 through mounting holes 41*a* in the support sheet clips 40*a*. Thermal insulating spacer blocks 30 are optionally installed onto the roof clips 10 with tongue and side wall extensions 32, 34 meshing with the roof clip legs 12. Thermal insulation 55 is payed out or otherwise deposited onto the support sheet 50 to fill the insulation cavity (for example, up to the upper ends of the roof clips 10). The roof panel 5 is then installed onto the roof clips 10.

Figure 8:
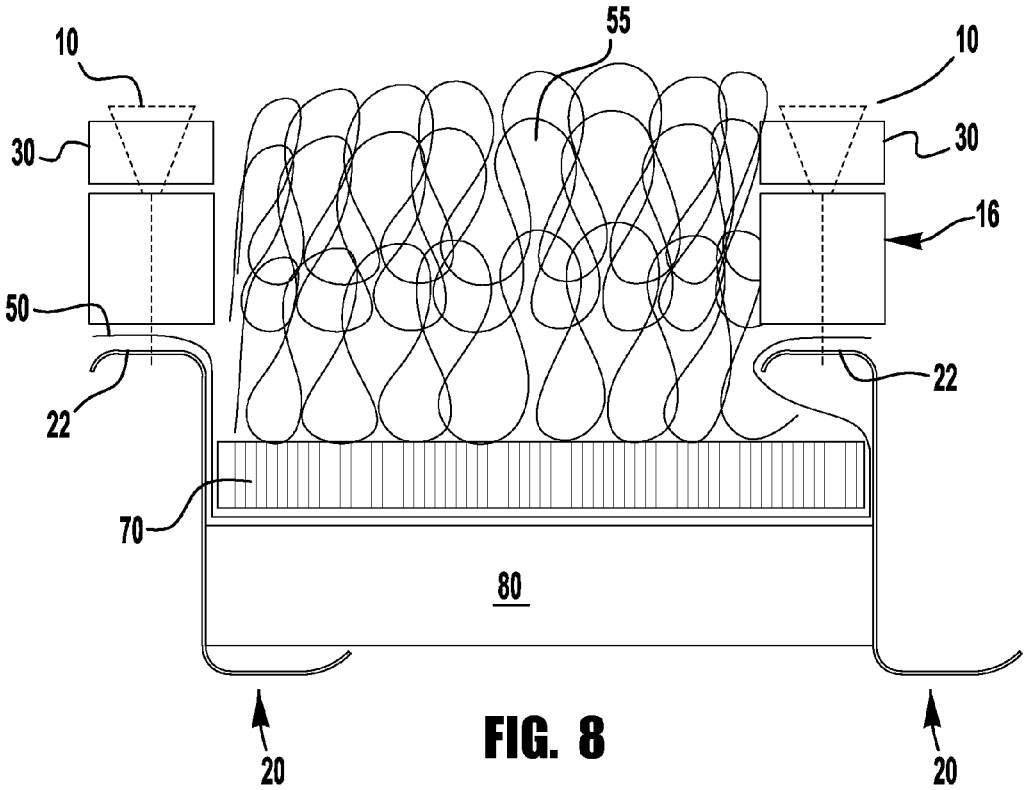
FIG. 8 is a schematic cross-sectional view of a metal roofing arrangement utilizing a rigid insulation cavity expanding component installed over or inside the support sheet.

According to another aspect of the present application, one or more rigid components (e.g., a board, panel, or bracing) may be installed between adjacent purlins and above the support sheet to conform at least a portion of the support sheet to substantially span the space between the adjacent purlins, to reduce the amount of empty, un-insulated space between the purlins. In one embodiment, as shown in FIG. 8, a rigid, insulating board 70 (e.g., a foam or fiberglass board) may be inserted between the purlins 20 and above the support sheet 50 to form a bottom surface of an insulation cavity that substantially spans the space between the adjacent purlins 20. Additional insulation material 55 (e.g., rolled or blown-in fiberglass material) may then be supplied above the insulating board 70 to substantially fill the insulation cavity. Additional rigid components (not shown) may be inserted above some or all of the supplied insulation material 55 to further expand the insulation cavity between the purlins 20. As shown, the insulation cavity may be supported from below the support sheet 50 by one or more braces 80. In another embodiment, as shown in FIG. 9, one or more braces 80 may be installed above the support sheet 50 (for example, replacing the insulation board 70) and between the purlins 20 to extend the support sheet to form an extended bottom surface of an insulation cavity (as compared to a conventional sagging support sheet) that substantially spans the space between the adjacent purlins 20.

Figure 9:
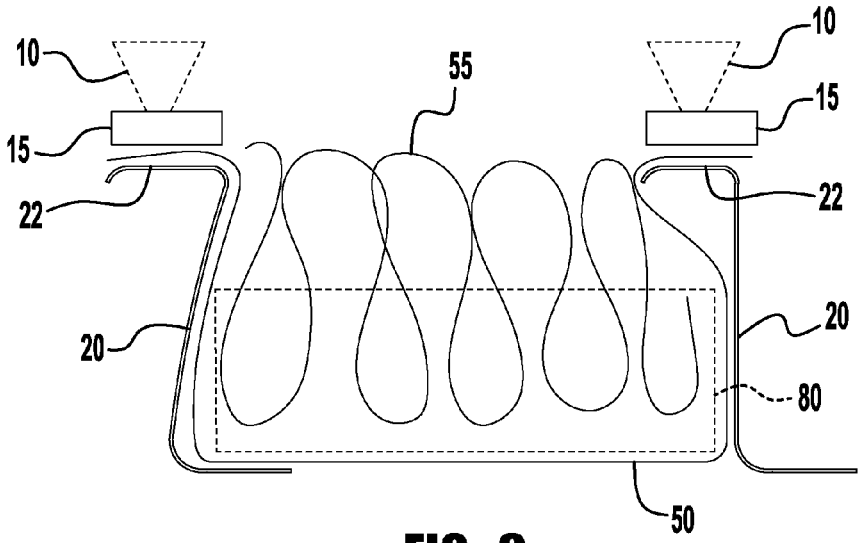
FIG. 9 is a schematic cross-sectional view of a metal roofing arrangement utilizing a bracing component installed over or inside the support sheet.

To install an exemplary insulated metal roofing system utilizing some of the above described features, as shown in FIGS. 8 and 9, one or more support sheets 50 are payed out across the purlins 20. One or more rigid boards 70, braces 80, or other rigid components are inserted between adjacent purlins 20 and onto support sheets 50 to spread a portion of the support sheet to substantially span the space between the adjacent purlins. Roof clips 10 with spacer washers 15 (see FIG. 9) and/or spacer blocks 16 (see FIG. 8) are fastened to the purlins 20. Thermal insulating spacer blocks 30 (see FIG. 9) may be installed onto the roof clips 10 with tongue and side wall extensions 32, 34 meshing with the roof clip legs 12 (see FIGS. 2A, 2B). Thermal insulation 55 is payed out or otherwise deposited onto the support sheet 50 to fill the insulation cavity (for example, up to the upper ends of the roof clips 10). The roof panel (not shown) is then installed onto the roof clips 10.

According to still another aspect of the present application, an insulation cavity between the roof panels and purlins of a metal roof may be expanded by increasing the vertical space between the roof panels and the purlins to allow for installation of additional insulation material. In one embodiment, the size of the roof clips supporting the roof panels may be increased (e.g., made taller) to increase the vertical space between the roof panels and purlins. In another embodiment, insulating spacers may be secured above the purlins and below the roof panels to vertically expand the insulation cavity. While the insulating spacers may be provided in many different suitable structures, in one embodiment, insulating spacer blocks are secured between the purlins and roof panels. The spacer blocks may be sized to produce an insulation cavity large enough to provide a desired insulation rating (for example, a desired R-value or U-factor, such as a maximum U-factor of 0.035), for example, to meet or exceed applicable energy codes, when the insulation cavity is filled with a selected insulation material.

Figure 10:
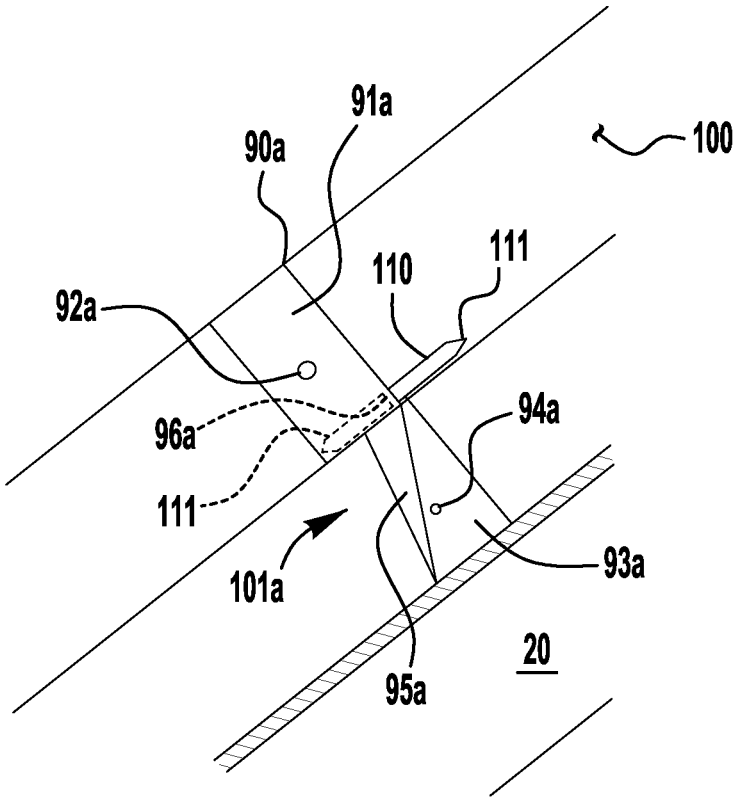
FIG. 10 is a partial schematic perspective view of a metal roofing arrangement utilizing a z-shaped cavity expanding bracket assembled with the purlin.
Figure 11:
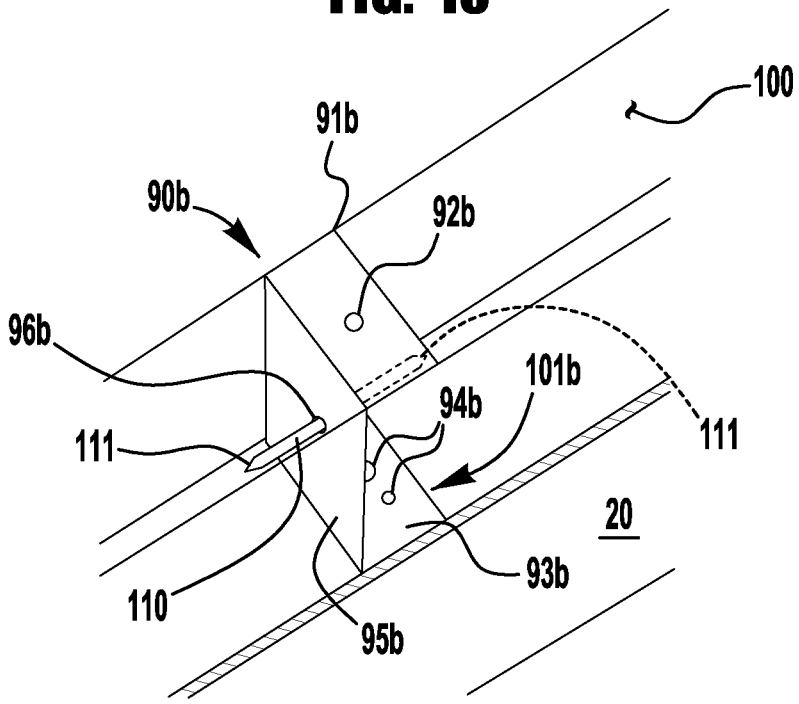
FIG. 11 is a partial schematic perspective view of a metal roofing arrangement utilizing a c-shaped cavity expanding bracket assembled with the purlin.

While the insulating spacers may be secured between the roof panels and purlins of a metal roof using many different arrangements, in one embodiment, an attachment arrangement utilizes a cavity expanding bracket having a lower end securable to the purlin and an upper end securable to the roof clip. FIG. 10 illustrates an exemplary z-shaped cavity expanding bracket 90*a* having a longitudinally extending (i.e., along the length of the purlin) upper portion 91*a* with a mounting hole 92*a*, a longitudinally extending lower portion 93*a* with a mounting hole 94*a*, and a vertical connecting portion 95*a* sized to define the vertical height of the insulation cavity extension above the purlins 20. FIG. 11 illustrates an exemplary C-shaped cavity expanding bracket 90*b* having a longitudinally extending upper portion 91*b* with a mounting hole 92*b*, a longitudinally extending lower portion 93*b* with a mounting hole 94*b*, and a vertical connecting portion 95*b* sized to define the vertical height of the insulation cavity extension above the purlins. The bracket may be provided in any suitable material including, for example, 14 gauge steel. The cavity expanding bracket 90*a*, 90*b* defines a longitudinal slot or recess 101*a*, 101*b* between the upper end 91*a*, 91*b* and the purlin 20 into which an insulating spacer block 100 is received (see FIG. 10A). The mounting holes 94*a*, 94*b* in the lower end 93*a*, 93*b* of the bracket 90*a*, 90*b* may be used to secure the bracket (directly or indirectly) to the purlin 20. The mounting holes 92*a*, 92*b* in the upper end 91*a*, 91*b* of the bracket 90*a*, 90*b* may be used to secure the roof clip 10, cavity expanding bracket 90*a*, 90*b*, and insulating spacer block 100 together, for example, to prevent longitudinal movement of the insulating spacer block. In other embodiment, self-drilling screws may be used to secure the cavity expanding bracket to one or more roof clips and purlins, such that mounting holes in the upper and lower ends of the bracket may not be required. The spacer block may be sized to match the height and width of the bracket (for example, approximately 6 inches in height and approximately 4 inches in width).

Figure 10A:
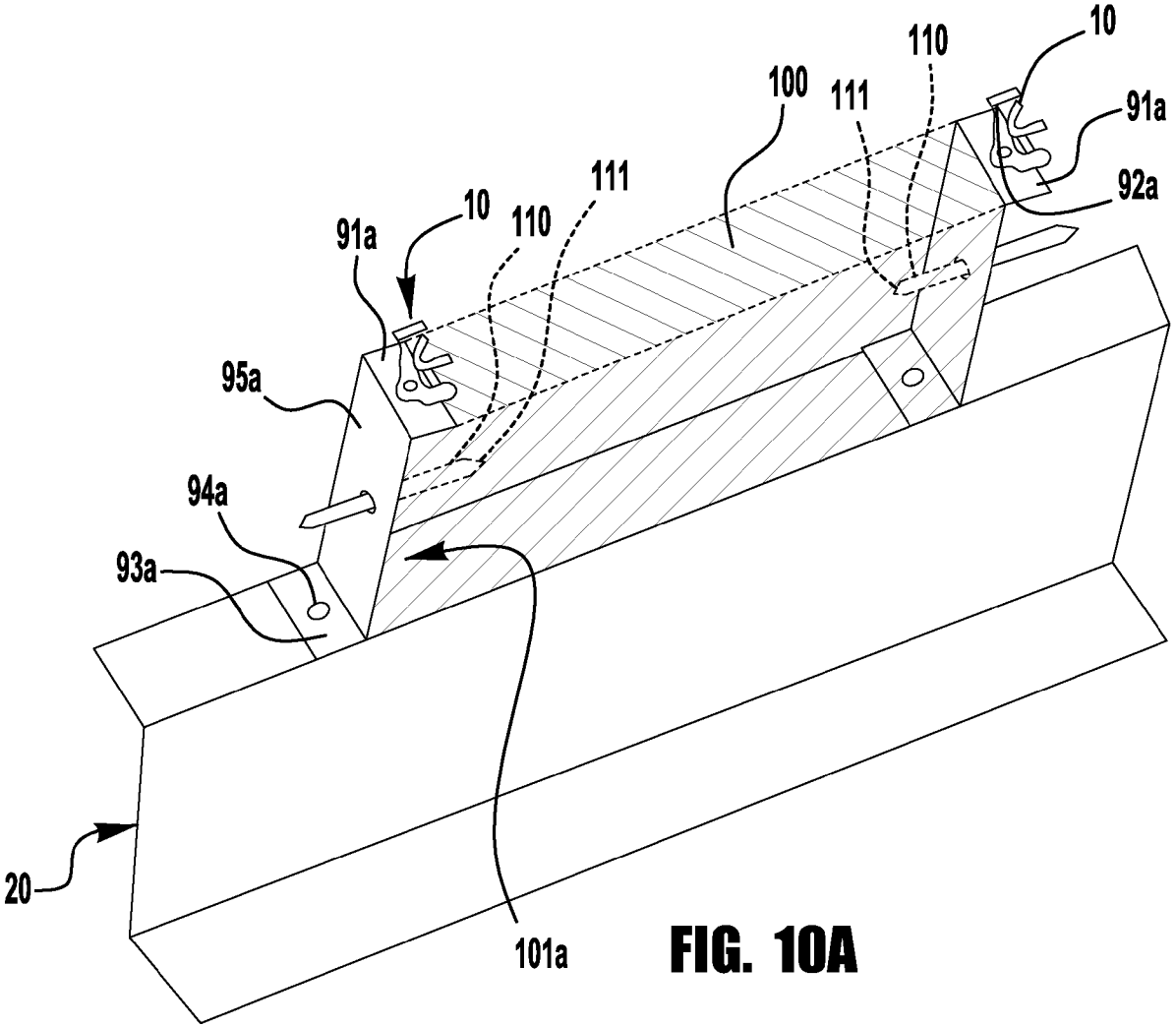
FIG. 10A is another schematic perspective view of the metal roofing arrangement of FIG. 10.

A cavity expanding bracket may be further configured to limit lateral movement of an insulating spacer block with respect to the purlin. In the examples of FIGS. 10, 10A and 11, a block position pin 110 may be inserted through a hole 96*a*, 96*b* in the vertical portion 95*a*, 95*b* of the bracket 90*a*, 90*b* for engagement with or receipt within the spacer block 100. While the spacer block may be provided with a longitudinally extending bore (not shown) for receiving the position pin 110, in the illustrated embodiments, the position pin is provided with a sharpened end 111 for embedding into a soft (e.g., foam) spacer block. Additionally, as shown, the position pin may be provided with two sharpened ends 111 for positioning adjacent spacer blocks 100 on either side of the bracket 90*a*, 90*b*.

Figure 12A:
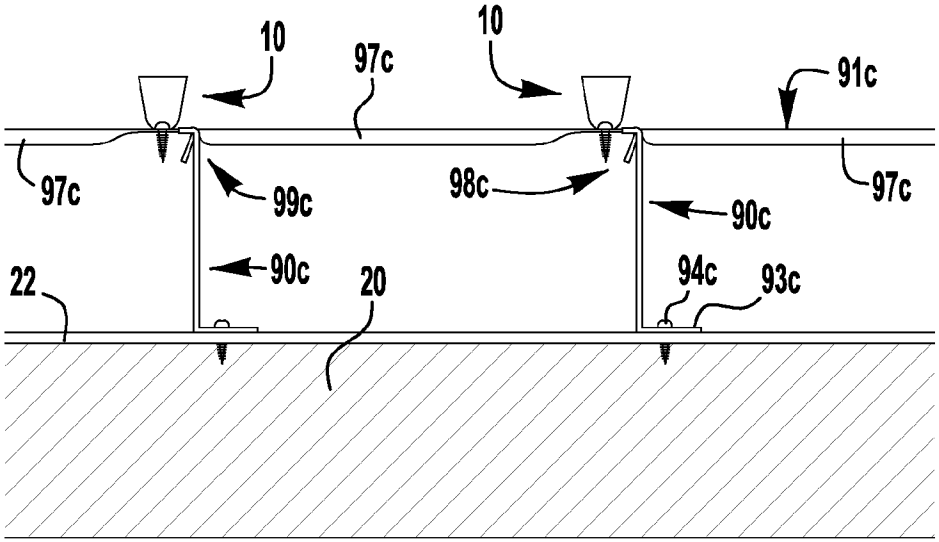
FIG. 12A is a partial schematic side view of a metal roofing arrangement utilizing interlocking cavity expanding brackets assembled with the purlin.
Figure 12B:
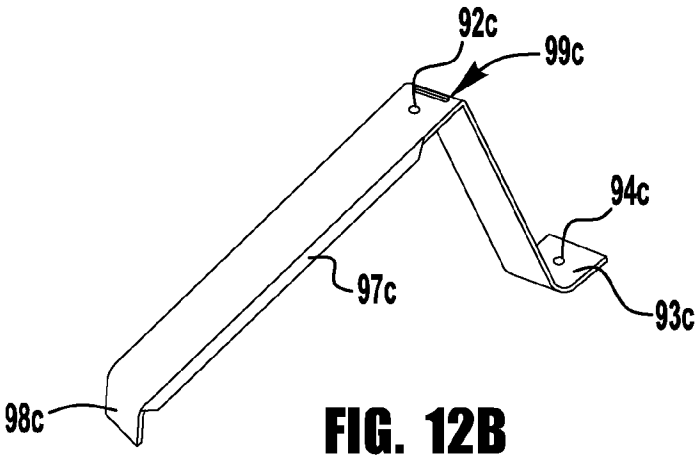
FIG. 12B is a schematic perspective view of the cavity extending bracket of FIG. 12A.

In another embodiment, a cavity expanding bracket may include vertically extending retaining portions configured to engage the spacer block to prevent lateral movement of the spacer block. For example, as shown in FIGS. 12A and 12B, a cavity expanding bracket 90*c* may include an upper portion 91*c* having longitudinally extending side flanges 97*c* positioned to engage longitudinal sides of a spacer block. To more securely retain the spacer block, the bracket upper portion 91*c* may be sized to extend the length of the spacer block. Further, the bracket 90*c* may be configured to interlock with an adjacent cavity extending bracket 90*c*, for example, to provide additional support for the roof panels and/or to facilitate proper positioning of the brackets 90*c*. As one example, as shown, the upper portion 91*c* of the bracket 90*c* may be provided with an end tab 98*c* that is received in a slot 99*c* of an adjacent bracket 90*c*. The tab 98*c* may be bent or otherwise configured to facilitate interlocking engagement between the two brackets 90*c*.

Interlocking cavity expanding brackets, such as, for example, the brackets of FIGS. 12A and 12B, may additionally provide increased structural support for a person and/or apparatus installing support sheets and/or insulation into the insulation cavity from above the brackets. For such an arrangement, the bracket upper portions and vertical portions may be configured to be strong enough to support the weight of an installer and the installation apparatus. As such, interlocking brackets and reinforced (e.g., with bent side flanges) upper bracket portions may be configured to provide sufficient structural support without thermal insulation blocks assembled with the brackets. In such an embodiment, recesses below the bracket upper portions may be filled with other insulation material (e.g., from a roll of fiberglass insulation).

Figure 13A:
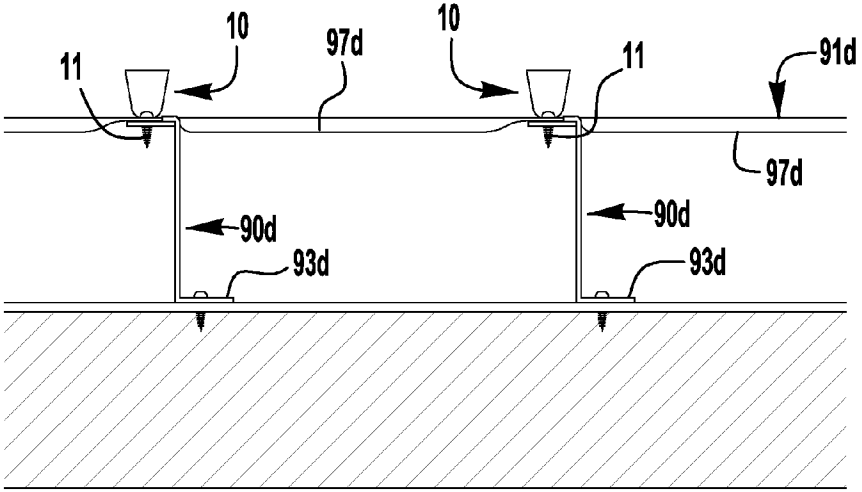
FIG. 13A is a partial schematic side view of another metal roofing arrangement utilizing interlocking cavity expanding brackets assembled with the purlin.
Figure 13B:
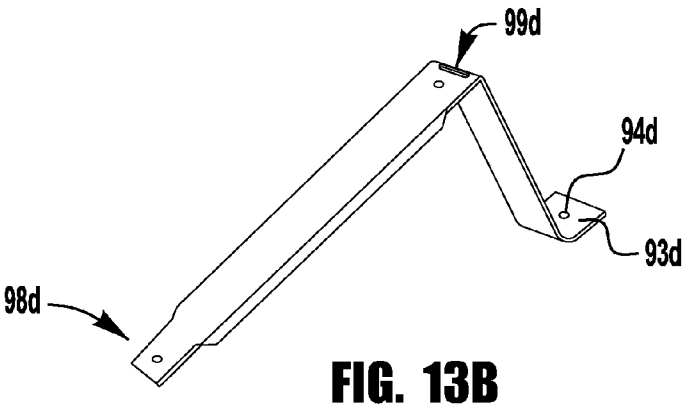
FIG. 13B is a schematic perspective view of the cavity extending bracket of FIG. 13A.

In an alternate embodiment, as shown in FIGS. 13A and 13B, adjacent cavity expanding brackets 90*d* may be secured to each other using an interlocking fastener arrangement, for example, to provide more secure attachment of the brackets 90*d* and load-bearing support for individuals and equipment used during roofing installation. In the illustrated embodiment of FIGS. 13A and 13B, the upper portion 91*d* of the bracket 90*d* may be provided with an end tab 98*d* that is received in a slot 99*d* of an adjacent bracket 90*d*. The tab 98*d* and the bracket upper portion 91*d* adjacent the slot 99*d* may be provided with mounting holes to receive a fastener (e.g., a roof clip fastener 11) therethrough, to provide secure interlocking engagement between the two brackets 90*d*, and additional load-bearing support.

To install an exemplary insulated metal roofing system utilizing some of the above described features, as shown in FIGS. 10-13B, one or more support sheets 50 are payed out across the purlins 20. Lower portions 93*a*, 93*b*, 93*c*, 93*d* of one or more cavity expanding brackets 90*a*, 90*b*, 90*c*, 90*d* are fastened to the upper portions 22 of the purlins 20 (for example, using fasteners installed through mounting holes 94*a*, 94*b*, 94*c*, 94*d*). In the embodiments of FIGS. 10 and 11 spacer blocks 100 are pushed onto opposite ends of a position pin 110 extending through holes 96*a*, 96*b* in vertical portions 95*a*, 95*b* of the brackets 90*a*, 90*b*. In the embodiment of FIG. 12A, 12B and 13A, 13B, spacer blocks 100 may (but need not) be received between side flanges 97*c*, 97*d* to retain the spacer blocks 100 above the purlins 20. Adjacent brackets 90*c*, 90*d* are interlocked with each other by inserting an end tab 98*c*, 98*d* of a first bracket 90*c*, 90*d* through a corresponding slot 99*c*, 99*d* in the second bracket 90*c*, 90*d*. Roof clips with optional spacer washers or spacer blocks (not shown) are fastened to the upper portions 91*a*, 91*b*, 91*c*, 91*d* of the brackets 90*a*, 90*b*, 90*c*, 90*d* (for example, using fasteners installed through mounting holes 92*a*, 92*b*, 92*c*, 92*d*). Thermal insulating spacer blocks (not shown) may be installed onto the roof clips with tongue and side wall extensions meshing with the roof clip legs. Thermal insulation (not shown) is payed out or otherwise deposited onto the support sheet to fill the insulation cavity (for example, up to the upper ends of the roof clips). The roof panels are then installed onto the roof clips.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasable or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A metal roofing system comprising:

at least one purlin having a laterally extending upper portion;

first and second roof clips each including a base portion secured to the upper portion of the at least one purlin, and flanged legs extending from opposite sides of the base portion;

a thermal spacer washer assembled between the first roof clip and the at least one purlin; and a laterally extending thermal insulating spacer block including a tongue extension at a first end and spaced apart side wall extensions at a second end opposite the first end;

wherein the tongue extension is inserted laterally between the flanged legs of the first roof clip, and the side wall extensions extend laterally around the flanged legs of the second roof clip.

2. The system of claim 1, further comprising a support sheet draped over the at least one purlin and secured between the first and second roof clips and the at least one purlin.

3. The system of claim 2, further comprising a support sheet clip assembled over the support sheet and an upper portion of the at least one purlin, the support sheet clip conforming a portion of the support sheet with a vertically extending portion of the at least one purlin.

4. The system of claim 1, further comprising a thermal insulation block secured to the first and second roof clips and the at least one purlin, the thermal insulation block being secured below the laterally extending upper portion of the at least one purlin.

5. The system of claim 1, further comprising a third roof clip including a base portion secured to the upper portion of the at least one purlin, and flanged legs extending from opposite sides of the base portion, and a second laterally extending thermal insulating spacer block including a tongue extension at a first end and spaced apart side wall extensions at a second end opposite the first end, wherein the tongue extension of the second laterally extending thermal insulating spacer block is inserted laterally between the flanged legs of the second roof clip, and the side wall extensions of the second laterally extending thermal insulating spacer block extend laterally around the flanged legs of the third roof clip.

6. The system of claim 1, wherein the tongue extension includes a notch sized to receive the thermal spacer washer.

7. A metal roofing system comprising:

at least one purlin having a laterally extending upper portion;

first and second roof clips each including a base portion secured to the upper portion of the at least one purlin, and flanged legs extending from opposite sides of the base portion; and a laterally extending thermal insulating spacer block including a tongue extension at a first end and spaced apart side wall extensions at a second end opposite the first end;

wherein the tongue extension is inserted laterally between the flanged legs of the first roof clip, and the side wall extensions extend laterally around the flanged legs of the second roof clip.

8. The system of claim 7, further comprising first and second thermal spacer washers assembled between the first and second roof clips and the at least one purlin.

9. The system of claim 8, wherein the tongue extension includes a notch sized to receive the first thermal spacer washer.

10. The system of claim 7, further comprising a support sheet draped over the at least one purlin and secured between the first and second roof clips and the at least one purlin.

11. The system of claim 10, further comprising a support sheet clip assembled over the support sheet and an upper portion of the at least one purlin, the support sheet clip conforming a portion of the support sheet with a vertically extending portion of the at least one purlin.

12. The system of claim 7, further comprising a thermal insulation block secured to the first and second roof clips and the at least one purlin, the thermal insulation block being secured below the laterally extending upper portion of the at least one purlin.

13. The system of claim 7, further comprising a third roof clip including a base portion secured to the upper portion of the at least one purlin, and flanged legs extending from opposite sides of the base portion, and a second laterally extending thermal insulating spacer block including a tongue extension at a first end and spaced apart side wall extensions at a second end opposite the first end, wherein the tongue extension of the second laterally extending thermal insulating spacer block is inserted laterally between the flanged legs of the second roof clip, and the side wall extensions of the second laterally extending thermal insulating spacer block extend laterally around the flanged legs of the third roof clip.

* * * * *